US012146387B2

(12) United States Patent
Sexton et al.

(10) Patent No.: US 12,146,387 B2
(45) Date of Patent: Nov. 19, 2024

(54) FLAPPER VALVE FOR PERCUSSION DRILL TOOLS

(71) Applicant: Mincon International Limited, Shannon (IE)

(72) Inventors: Ben Sexton, Limerick (IE); Markku Keskiniva, Ylinen (FI)

(73) Assignee: MINCON INTERNATIONAL LIMITED, Shannon (IE)

( * ) Notice: Subject to any disclaimer, the term of this patent is extended or adjusted under 35 U.S.C. 154(b) by 0 days.

(21) Appl. No.: 18/020,779

(22) PCT Filed: Aug. 18, 2021

(86) PCT No.: PCT/EP2021/072944
§ 371 (c)(1),
(2) Date: Feb. 10, 2023

(87) PCT Pub. No.: WO2022/038188
PCT Pub. Date: Feb. 24, 2022

(65) Prior Publication Data

US 2023/0304378 A1 Sep. 28, 2023

(30) Foreign Application Priority Data

Aug. 19, 2020 (IE) ..... 2020/0186

(51) Int. Cl.
*E21B 34/08* (2006.01)
*E21B 4/14* (2006.01)
*F16K 31/08* (2006.01)

(52) U.S. Cl.
CPC ..... *E21B 34/08* (2013.01); *E21B 2200/05* (2020.05)

(58) Field of Classification Search
None
See application file for complete search history.

(56) References Cited

U.S. PATENT DOCUMENTS 1,470,074 A * 10/1923 Gomez ..... B25D 9/24 173/78
3,131,606 A * 5/1964 Oelke ..... E21B 4/14 92/151

(Continued)

OTHER PUBLICATIONS

International Search Report from corresponding International Patent Application No. PCT/EP2021/072944, dated Nov. 5, 2021.

(Continued)

*Primary Examiner* — Matthew R Buck
*Assistant Examiner* — Douglas S Wood
(74) *Attorney, Agent, or Firm* — KUSNER & JAFFE

(57) ABSTRACT

The present invention relates to a flapper valve for a percussion drill tool. The valve comprises a first side engageable with a planar surface of an element of the percussion drill tool to alternately close first and second fluid flow paths of the percussion drill tool. The planar surface comprises first and second apertures in fluid communication with the first and second fluid flow paths, respectively. The first side of the flapper valve comprises a first planar portion and a second planar portion and a first curved tip portion intermediate the first and second planar portions. The flapper valve is pivotable about the first curved tip portion between a first position, in which the first planar portion of the flapper valve is in sealing contact with the planar surface to close the first aperture, and a second position, in which the second planar portion of the flapper valve is in sealing contact with the planar surface to close the second aperture.

9 Claims, 10 Drawing Sheets

(56) References Cited

U.S. PATENT DOCUMENTS 3,683,962 A * 8/1972 Good ..... F16K 11/168 137/868
3,870,113 A * 3/1975 Slawson ..... E21B 4/16 175/96
4,527,590 A * 7/1985 Kolze ..... F16K 31/10 137/596.17
5,983,941 A * 11/1999 Fritz ..... F16K 31/0682 137/625.65
6,186,175 B1 * 2/2001 Frisch ..... F16K 11/0525 137/625.66
6,484,754 B1 * 11/2002 Muth ..... F16K 11/052 137/625.66
6,962,323 B2 * 11/2005 Buchheim ..... F02K 9/805 137/625.21
8,434,514 B2 * 5/2013 Bezold ..... F16K 11/022 137/625.65
8,435,414 B2 * 5/2013 Takeuchi ..... B41J 2/162 216/17
2011/0155931 A1 * 6/2011 Weiss ..... F16K 31/06 251/65
2012/0223264 A1 * 9/2012 Doerr ..... F16K 31/0682 251/129.15

OTHER PUBLICATIONS

Written Opinion of the International Searching Authority from corresponding International Patent Application No. PCT/EP2021/072944, dated Nov. 5, 2021.

International Preliminary Report on Patentability from the International Preliminary Examining Authority from corresponding International Patent Application No. PCT/EP2021/072944, dated Aug. 24, 2022.

* cited by examiner

FLAPPER VALVE FOR PERCUSSION DRILL TOOLS

FIELD OF THE INVENTION

The present invention relates to fluid-operated percussion drill tools, and in particular, to flapper valves for controlling air distribution in pneumatic drill tools.

BACKGROUND TO THE INVENTION

Conventional down-the-hole hammers and fluid-operated percussion drill tools, such as that shown in FIG. 1, typically comprise an external cylinder or outer wear sleeve 2, within which is mounted an inner cylinder 21 which in turn engages with a backhead assembly 3. A sliding reciprocating piston 1 co-operates with the inner cylinder 21 and backhead assembly 3, so that when air pressure is supplied through the backhead assembly, the piston acts with a percussive effect on a drill bit 13 retained within a chuck 22 on the outer wear sleeve.

Pressurised air is supplied from the backhead 3 alternately to upper and lower chambers 11, 12 to cause reciprocation of the piston. This can be achieved using a flat flapper valve 4 and an air distributor 16 having an upper surface 5 with three flats 6, 7, 8, as shown in FIG. 1. Flats 7 and 8 are angled downwards with respect to centre flat 6. One side 9 of the distributor supplies air to an upper chamber 11 above the piston and the other side 10 of the distributor assembly supplies air to a lower chamber 12 below the piston. The flapper valve 4, shown in a neutral position in FIG. 1, is arranged to pivot about the edges of the centre flat 6 of the air distributor. When the flapper valve is pivoted to one side 9, it contacts flat 8 thereby sealing off a hole or holes 14 in the distributor so that air is routed through a hole or holes 15 in the other side 10 of the distributor assembly and into channels 24 between the wearsleeve 2 and the inner cylinder 21 to exit underneath the piston where it pressurises the lower chamber 12, thereby causing the piston to move upwards, away from the bit 13. At this point in the cycle, the upper chamber 11 exhausts through the piston bore 18 and the bit bore 23. As the piston moves upwards, the piston bore 18 engages with and seals against an extension 17 of the air distributor, so that the upper chamber can no longer exhaust through the piston bore. The upper chamber 11 is also reducing in volume as the piston moves upwards, so that the pressure in the upper chamber is increasing. When the piston reaches a point where the piston nose 19 moves out of sealing engagement with the aligner 20, the lower chamber 12 begins to exhaust through the bit bore 23, so that the pressure in the lower chamber decreases. When the pressure in the lower chamber falls below the pressure in the upper chamber, the pressure differential causes the flapper valve 4 to switch position so that it contacts flat 7, sealing off holes 15 in the air distributor 16. Air is then permitted to flow through the holes 14 in the other side 9 of the distributor assembly to further pressurise the upper chamber, thereby pushing the piston back downwards towards the drill bit. As the piston moves downwards, the piston nose 19 moves back into sealing engagement with the aligner 20, so that the lower chamber can no longer exhaust through the bit bore 23, and the distributor extension 17 moves out of engagement with the piston bore 18, so that the upper chamber begins to exhaust once again. The volume of the lower chamber therefore reduces, and the pressure in the lower chamber begins to increase again, restarting the cycle. The flapper valve thus "flaps" or rocks back and forth about the edges of flat 6, alternately contacting flats 7 and 8 of the distributor.

While this this type of arrangement is useful due to its simplicity, it suffers from a number of disadvantages, specifically that the flapper valve tends to fail due to fatigue once the operating pressure goes above an upper threshold due to the cyclic loading of higher forces on the valve. Flapper valves also have a relatively short lifetime. Because the rocking movement of the valve is not smooth, the valve is subject to relatively high stresses. It is therefore desirable to provide a flapper valve arrangement that allows for increased lifetime and that can operate over a wider range of pressures.

SUMMARY OF THE INVENTION

According to an aspect of the present invention, there is provided a flapper valve for a percussion drill tool, comprising:

a first side engageable with a planar surface of an element of the percussion drill tool to alternately close first and second fluid flow paths of the percussion drill tool, the planar surface comprising first and second apertures in fluid communication with the first and second fluid flow paths, respectively, wherein the first side of the flapper valve comprises a first planar portion and a second planar portion and a first curved tip portion intermediate the first and second planar portions, such that the flapper valve is pivotable about the first curved tip portion between a first position, in which the first planar portion of the flapper valve is in sealing contact with the planar surface to close the first aperture, and a second position, in which the second planar portion of the flapper valve is in sealing contact with the planar surface of the distributor to close the second aperture.

Preferably, the first planar portion, the second planar portion and the first curved tip portion are arranged to form a single continuous surface without edges, corners or discontinuities therebetween. An advantage of this arrangement is that the flapper valve rotates (or rocks or pivots) about the curved tip portion of the valve, thereby allowing for a smoother operation than existing arrangements. In turn, this provides for an increased valve lifetime and increased tolerance to higher operating pressures due to reduced stresses on the valve.

In one embodiment, the planar surface is a planar proximal (or rear or upper) surface of an intermediate plate arranged proximal to (or rearwardly of or above) a fluid distributor of the percussion drill tool. In other embodiments, the planar surface may be integrally formed with the fluid distributor to form a planar proximal (or rear or upper) surface of the fluid distributor of the percussion drill tool. A flapper valve assembly may comprise the flapper valve and the intermediate plate and/or the fluid distributor.

The first curved tip portion of the flapper valve preferably has a radius of curvature of between 10 mm and 10000 mm. Selection of the radius of curvature of the first curved tip portion allows the performance of the valve to be tuned. For example, a larger radius of curvature of the first curved tip portion may provide improved high power, low frequency performance, whereas a smaller radius of curvature may provide improved performance at low power and high frequencies. For certain applications, a radius of curvature of approximately 500 mm may be particularly advantageous.

The first curved tip portion is arranged between the first and second planar portions such that an angle between the first and second planar portions is greater than 180 degrees. As the flapper valve moves from the first position or the second position to a neutral position (intermediate the first and second positions) it moves through a stroke angle. The angle between the first and second planar portions is 180 degrees plus twice the stroke angle. Generally, a higher stroke angle results in a more responsive valve, which increases operating frequency but decreases power. In contrast, a lower stroke angle may not provide sufficient flow area on the "open" side of the distributor to allow sufficient air to be supplied to the chamber, which can lead to the valve switching too early due to the pressure differential across the valve. It is therefore necessary to select an appropriate stroke angle to allow effective operation of the valve. Preferably, the stroke angle is between one and 10 degrees. Ideally, the stroke angle is approximately three degrees so that, as the flapper valve rocks over and back, it describes an angle of approximately six degrees.

In one embodiment, the first and second planar portions of the first side of the flapper valve are equal in length so that the curved tip portion is located along a centre line of the valve. The operation of the valve in this embodiment is symmetrical.

In another embodiment, the curved tip portion is offset from the centre line of the valve, so that the first and second planar portions have different lengths. The use of an offset biases the valve such that the longer planar portion of the valve is in contact with the planar surface due to an increased force generated by pressurised fluid on the larger portion, due to its larger surface area. In this embodiment, the valve is still pivotable about the curved tip portion such that the smaller planar portion of the valve is in contact with the planar surface, but the default position will be to have the larger side closed. A pressure differential between upper and lower chambers of the percussion drill tool, which are connectable to the first and second fluid flow paths respectively, causes the valve to flip or rock over and back when in use. When the area of each of the first and second fluid apertures is the same, a higher pressure is required to flip the valve when the larger planar portion is in contact with the distributor, thereby biasing the larger portion closed. The position of the tip portion relative to the centre line of the flapper valve affects the degree to which the valve is biased in one direction.

In some embodiments, a second side of the flapper valve, opposed to the first side, is planar. However, in other embodiments, the second side of the flapper valve comprises a third planar portion and a fourth planar portion and a second curved tip portion intermediate the third and fourth planar portions. Thus, the flapper valve may be reversed such that the second side of the valve is engageable with the planar surface to alternately close first and second fluid flow paths of the percussion drill tool. In this arrangement, the flapper valve is pivotable about the second curved tip portion between a third position, in which the third planar portion of the flapper valve is in sealing contact with the planar surface to close the first aperture, and a fourth position, in which the fourth planar portion of the flapper valve is in sealing contact with the planar surface to close the second aperture.

In certain embodiments, the radius of curvature of the first curved tip portion is the same as the radius of curvature of the second curved tip portion. This allows the lifetime of the valve to be extended by reversing the flapper valve.

However, in other embodiments, the radius of curvature of the first curved tip portion is different from that of the second curved tip portion. This allows each side of the flapper valve to have different operating characteristics. As set out above, the radius of curvature can be used to tune the performance of the valve. Providing two different radiuses of curvature on the same valve allows the operator to tune the performance of the hammer by switching the flapper valve to the other side.

Each of the first and second curved tip portions may be located on the centre line of the flapper valve or may be offset therefrom. One tip portion may be located on the centre line of the flapper valve and the other may be offset therefrom, or both tip portions may be offset from the centre line by the same or different amounts and in the same or different directions. This allows the direction in which the valve is biased and/or the degree to which the valve is biased in one direction to be selected by selecting the appropriate side of the valve.

Preferably, the flapper valve is formed from steel. In other embodiments, the valve may be formed from an engineering plastic material.

According to a second aspect of the present invention, there is provided a flapper valve assembly comprising a flapper valve as set out above, wherein first and second ends of the flapper valve have a convex profile, and a flapper valve guide having at least one internal recess dimensioned to receive the flapper valve and to restrain lateral movement of the flapper valve when the valve pivots between the first and second positions. In an embodiment, the flapper valve guide comprises a pair of internal recesses, each dimensioned to receive one end of the flapper valve. Preferably, each internal recess comprises an angled internal surface configured to co-operate with the convex end of the flapper valve to restrain lateral movement of the flapper valve.

An advantage of the flapper valve guide is that it minimises lateral movement of the flapper valve as it pivots from the first position to the second position.

According to another aspect of the invention, there is provided a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, and further comprising a flapper valve or flapper valve assembly as described above configured to control a flow of air to cause the reciprocating movement of the piston.

DETAILED DESCRIPTION OF THE DRAWINGS

Figure 1:
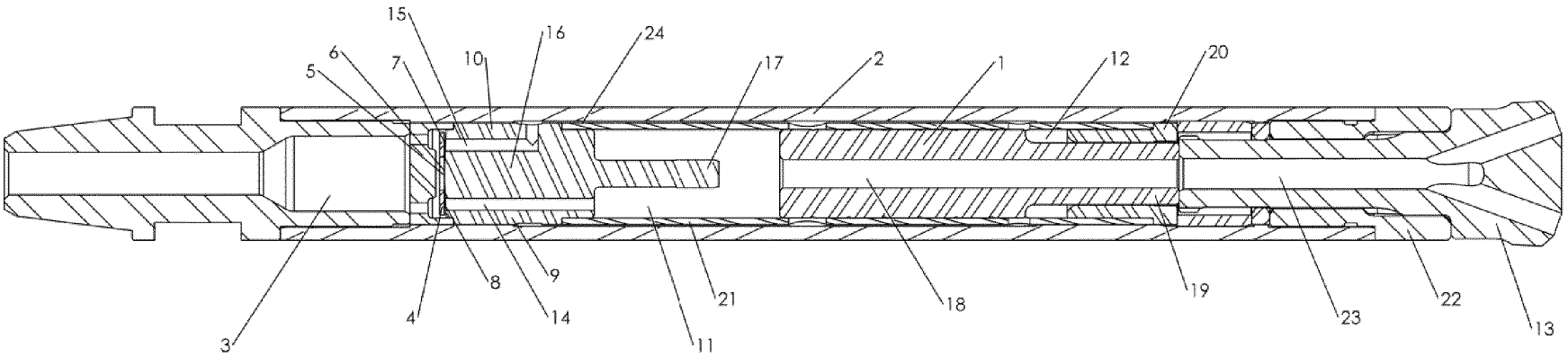
FIG. 1 is a longitudinal cross-sectional view of a percussion drill tool including a conventional flapper valve arrangement.
Figure 2:
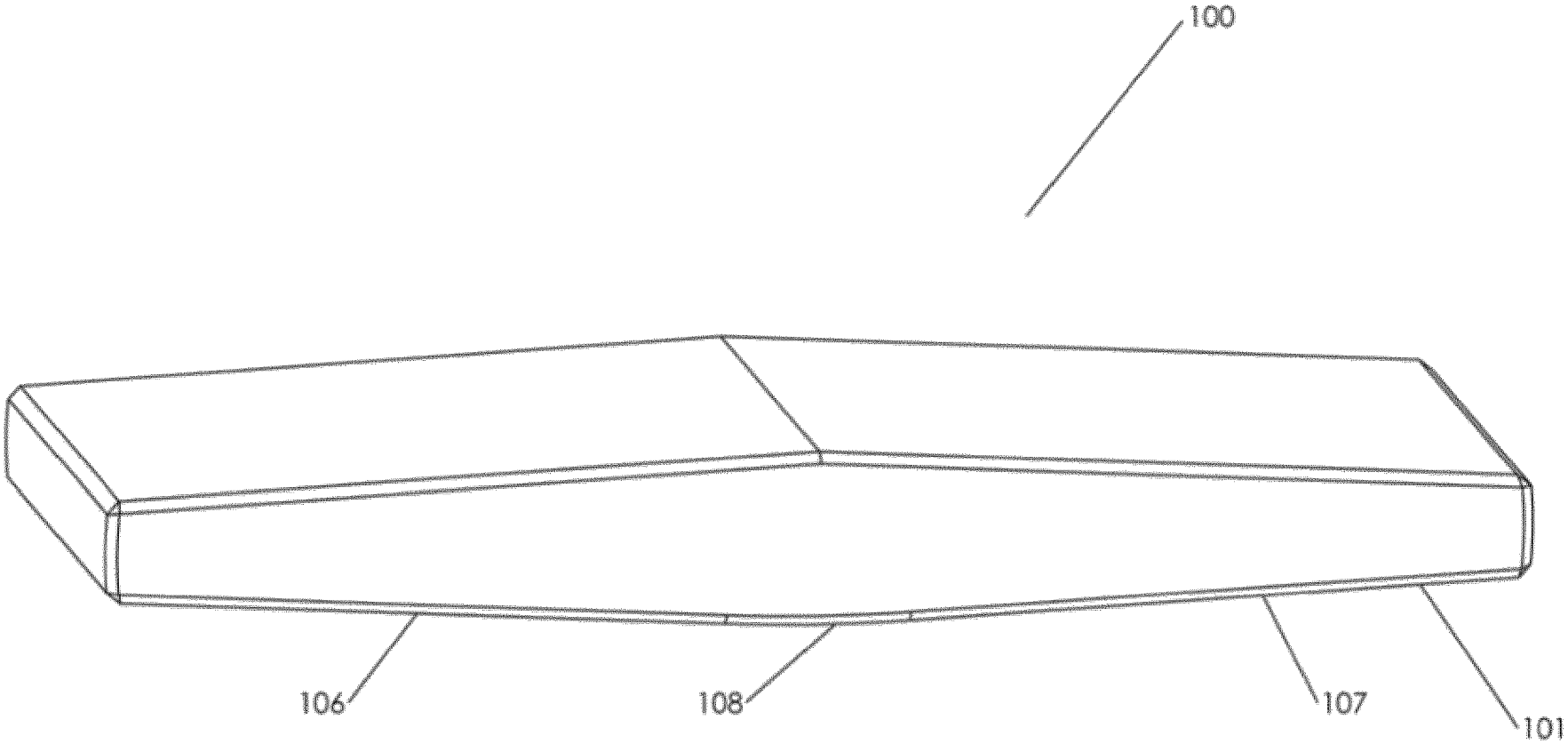
FIG. 2 is a perspective view of a flapper valve according to the present invention.
Figure 3:
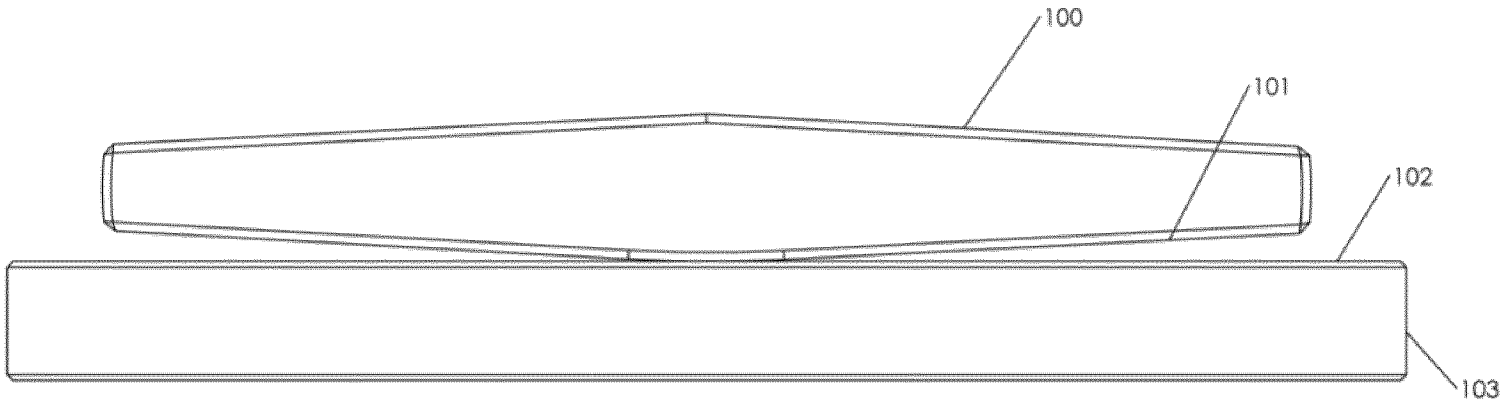
FIG. 3 is a side elevation view of a flapper valve according to a first embodiment of the invention, shown in use with an intermediate plate of a percussion drill tool.
Figure 4:
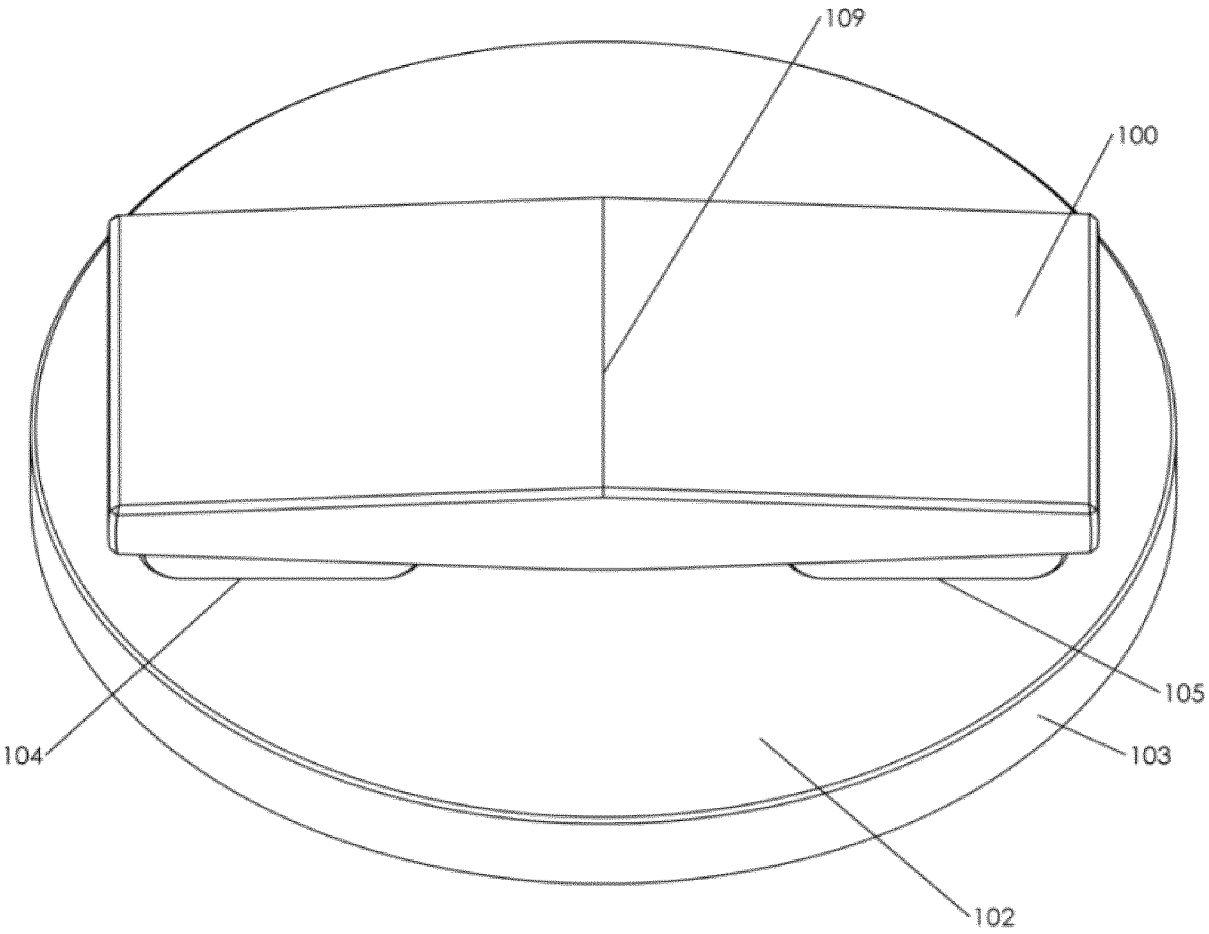
FIG. 4 is a top perspective view of the arrangement of FIG. 3.

A flapper valve 100 according to a first embodiment of the present invention is illustrated in FIG. 2. The valve comprises a first side 101 engageable with a planar surface 102 of an intermediate baseplate 103 of a percussion drill tool as shown in FIGS. 3 and 4 to alternately close first and second fluid flow paths of the percussion drill tool. The planar surface 102 comprises first and second apertures 104, 105 in fluid communication with the first and second fluid flow paths, respectively.

The first side 101 of the flapper valve 100 comprises a first planar portion 106 and a second planar portion 107 and a first curved tip portion 108 intermediate the first and second planar portions. As shown, the first planar portion, the second planar portion and the first curved tip portion form a single continuous surface without edges, corners or discontinuities therebetween. The first and second planar portions 106, 107 of the first side 101 of the flapper valve are equal in length so that the curved tip portion 108 is located along a centre line 109 of the valve. The operation of the valve in this embodiment is therefore symmetrical.

Figure 5:
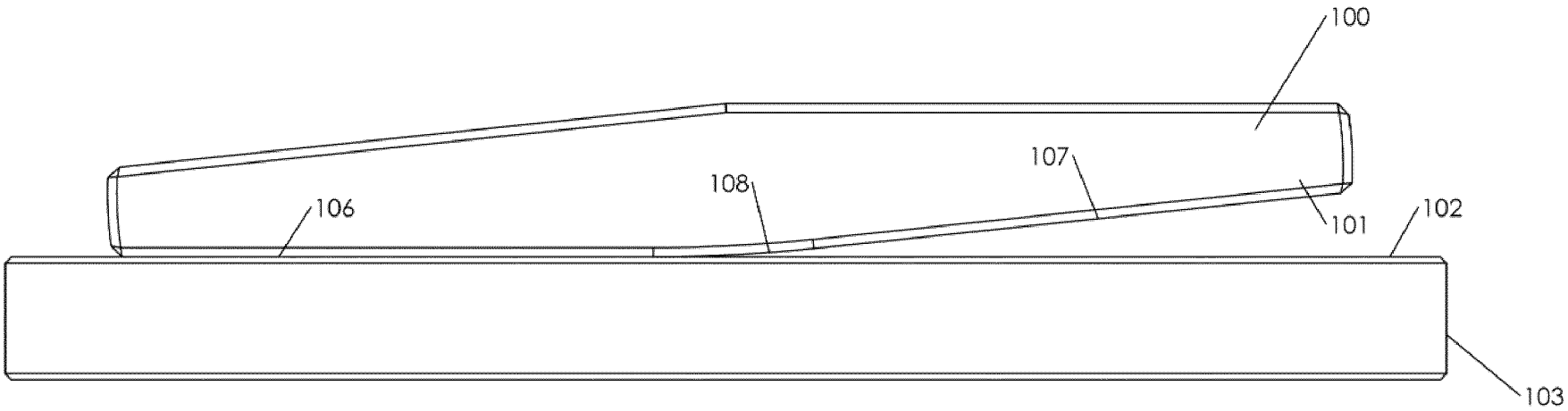
FIG. 5 is a side elevation view of the arrangement of FIG. 3, showing the flapper valve in a first position.

FIG. 5 shows the flapper valve 100 in a first position, in which the first planar portion 106 of the flapper valve is in sealing contact with the planar surface 102 to close the first aperture 104. The valve is pivotable about the first curved tip portion 108 from the first position to a second position, in which the second planar portion 107 of the flapper valve is in sealing contact with the planar surface 102 to close the second aperture 105.

In the embodiment shown in FIGS. 2 to 5, the flapper valve has a tip radius of 500 mm. In other embodiments, the radius of curvature of the first curved tip portion maybe be between 10 mm and 10000 mm.

In the embodiment shown in FIGS. 2 to 5, the angle between the first and second planar portions is approximately 186 degrees. As the flapper valve 100 moves from the first position shown in FIG. 5 to the neutral position shown in FIG. 3, it moves through a stroke angle of approximately three degrees. Thus, as the flapper valve rocks from over and back, it describes an angle of approximately six degrees.

Figure 6A:
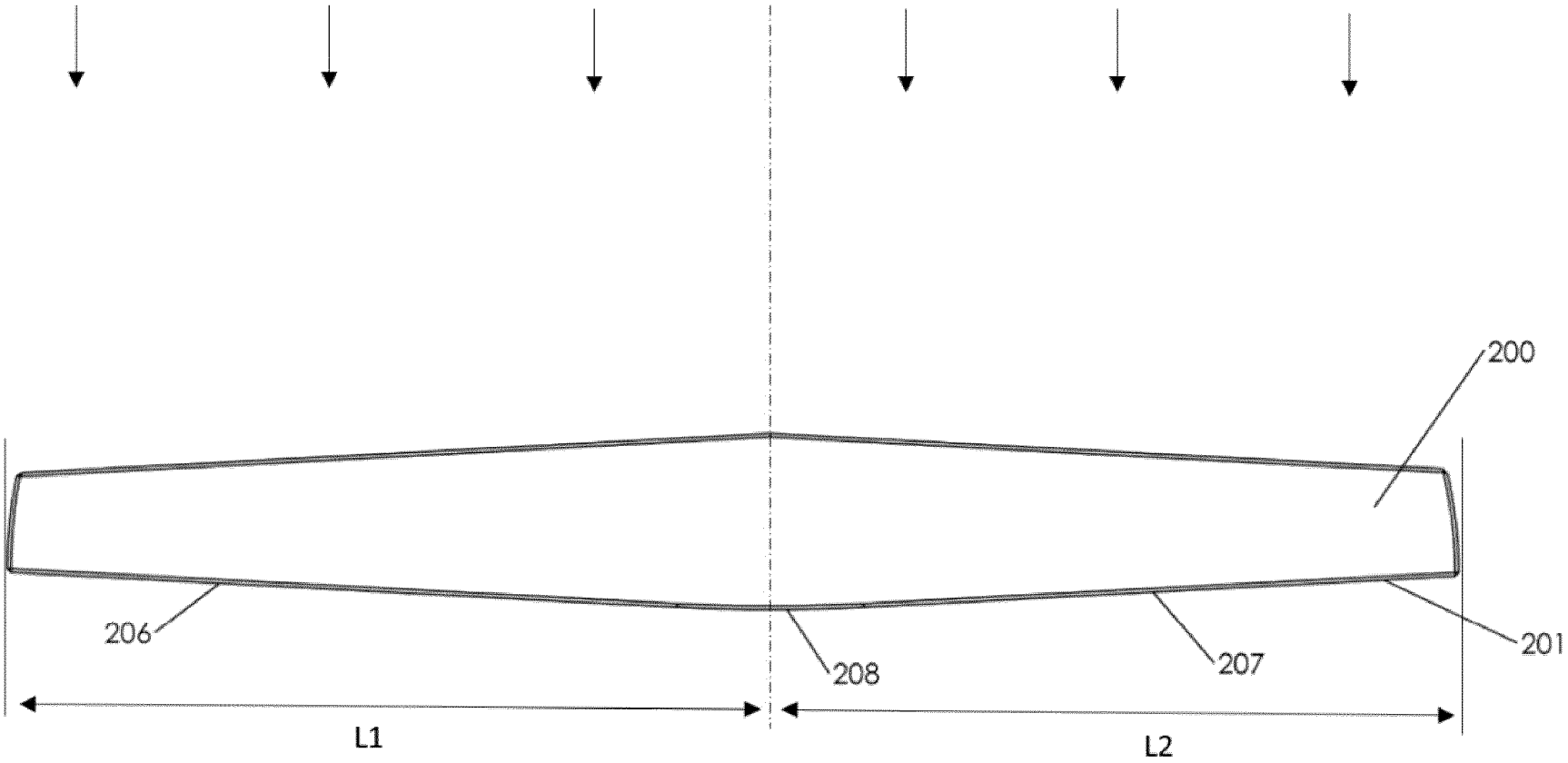
FIG. 6A is a side elevation view of a flapper valve according to a second embodiment of the invention.
Figure 6B:
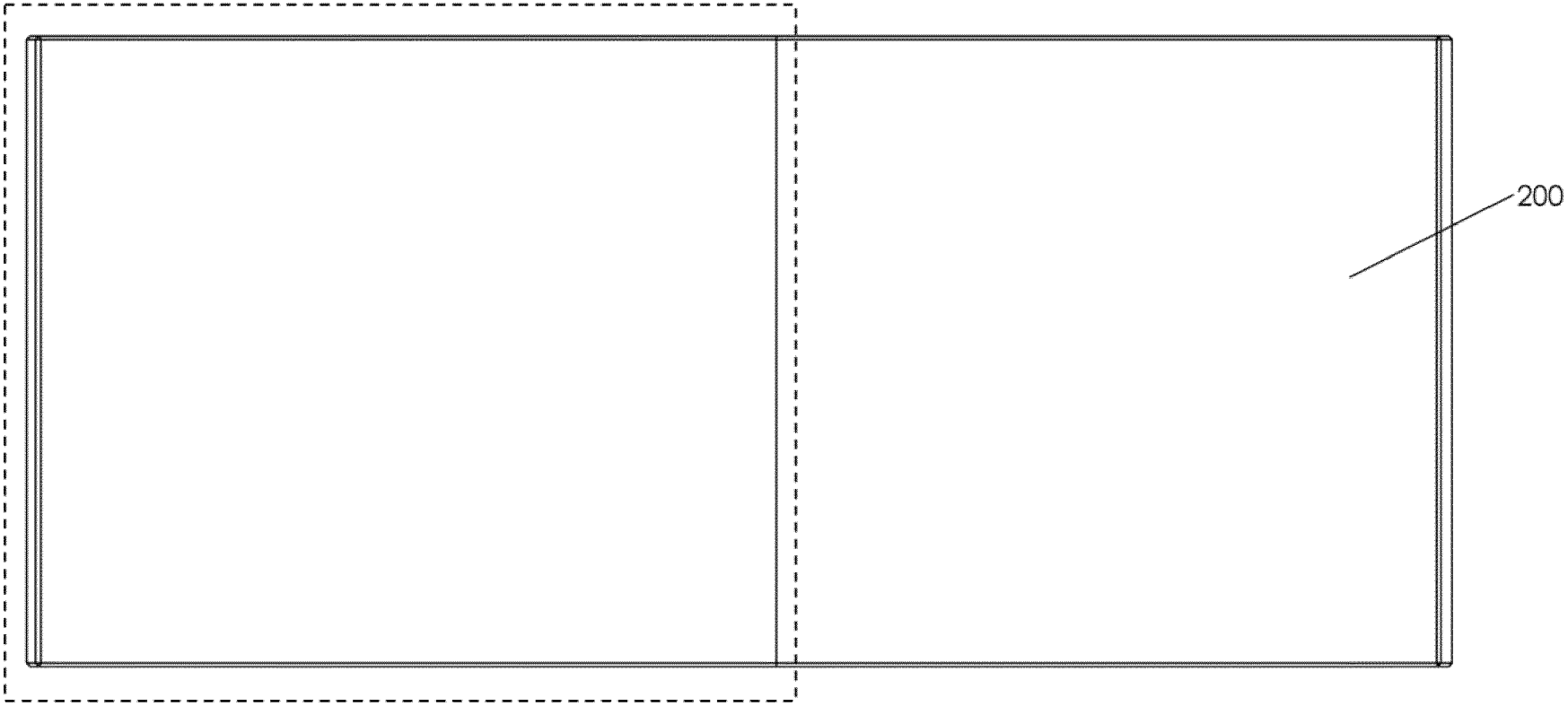
FIG. 6B is a top plan view of the flapper valve of FIG. 6A.

A flapper valve 200 according to another embodiment of the invention is shown in FIGS. 6A and 6B. In this embodiment, the first curved tip portion 208 is offset from the centre line of the valve, so that the first and second planar portions 206, 207 have different lengths L1 and L2 as shown in FIG. 6A. The use of an offset biases the valve such that the larger planar portion 206 of the valve is in contact with the planar surface due to the increased force generated by the fluid pressure of pressurised fluid supplied by a backhead assembly (shown by the arrows) on the longer side, due to its larger surface area. In this embodiment, the valve is still pivotable about the curved tip portion 208 such that the smaller planar portion of the valve is in contact with planar surface, but the default position will be to have the larger portion closed.

Figure 7:
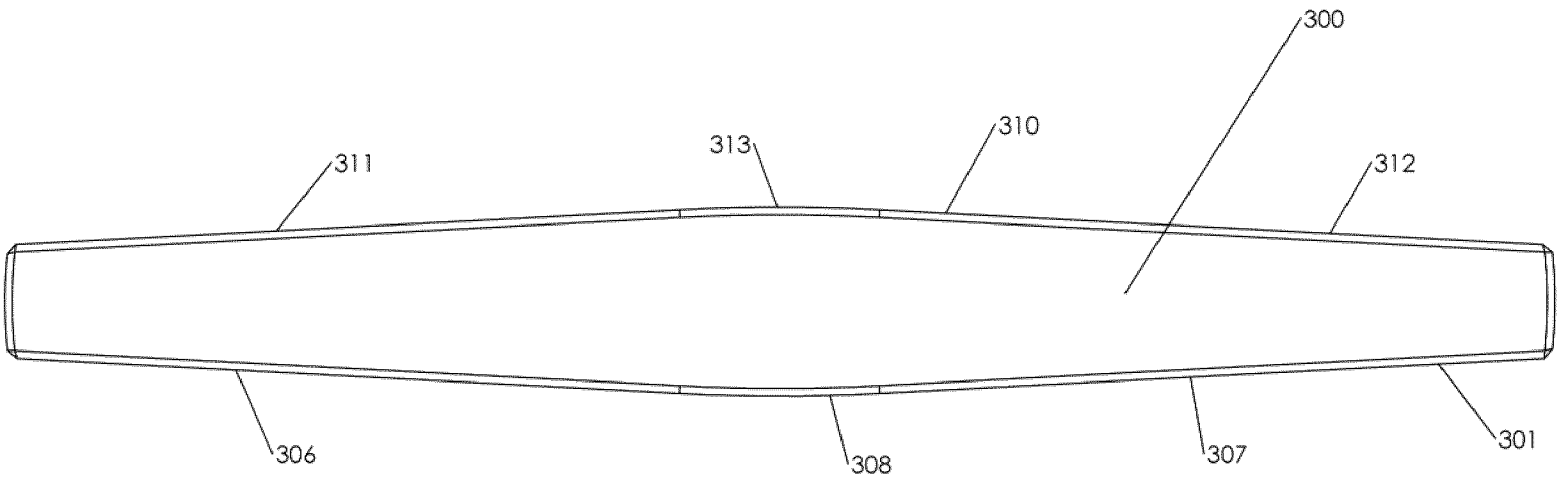
FIG. 7 is a side elevation view of a flapper valve according to a third embodiment of the invention.

A flapper valve 300 according to a third embodiment of the invention is shown in FIG. 7. The flapper valve 300 comprises a first side 301, including a first planar portion 306 and a second planar portion 307, joined by a first curved tip portion 308. The flapper valve further comprises a second side 310, opposite the first side 301. The second side 310 comprises a third planar portion 311 and a fourth planar portion 312 and a second curved tip portion 313 intermediate the third and fourth planar portions. Thus, the flapper valve 310 may be reversed such that the second side of the valve is engageable with the planar surface 102 to alternately close the first and second fluid flow paths of the percussion drill tool.

In the embodiment shown in FIG. 7, the radius of curvature of the first curved tip portion 308 is the same as the radius of curvature of the second curved tip portion 313. This allows the lifetime of the valve to be extended by reversing the flapper valve. In alternate embodiments, the radius of curvature of the first curved tip portion 308 may be different from that of the second curved tip portion 313. Providing two different radiuses of curvature on the same valve allows the operator to tune the performance of the hammer by switching the flapper valve to the other side.

In the embodiment shown in FIG. 7, the first curved tip portion 308 is located on the centre line of the flapper valve and the second curved tip portion 313 is offset therefrom. This allows the degree to which the valve is biased in one direction to be selected by selecting the appropriate side of the valve. In alternate embodiments, both tip portions may be located on the centre line of the flapper valve or each may be offset from the centre line by the same or different amounts.

Figure 8:
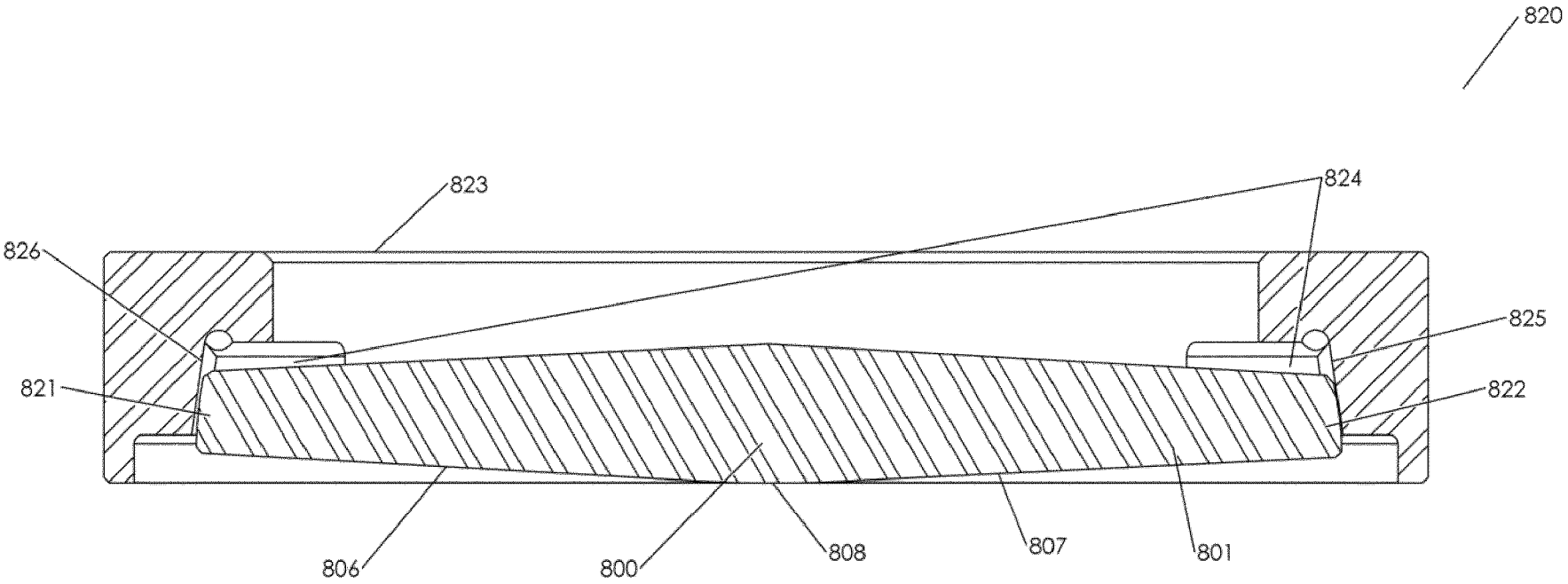
FIG. 8 is a cross-sectional view of a flapper valve assembly according to a second aspect of the invention.

A flapper valve assembly according to an embodiment of the present invention is shown in FIG. 8. The assembly 820 comprises a flapper valve 800 similar to that described above with reference to FIGS. 2 to 5, having a first side 801 comprising first and second planar portions 806 and 807 and a first curved tip portion 808. In this embodiment, each end 821, 822 of the flapper valve has a convex profile. The assembly further comprises a flapper valve guide 823 having a pair of internal recesses 824, each dimensioned to receive one end of the flapper valve 800. Each internal recess comprises an angled internal surface 825, 826 at its end, configured to co-operate with the convex ends 821, 822 of the flapper valve to restrain lateral movement of the flapper valve when the valve pivots between the first and second positions.

Figure 9:
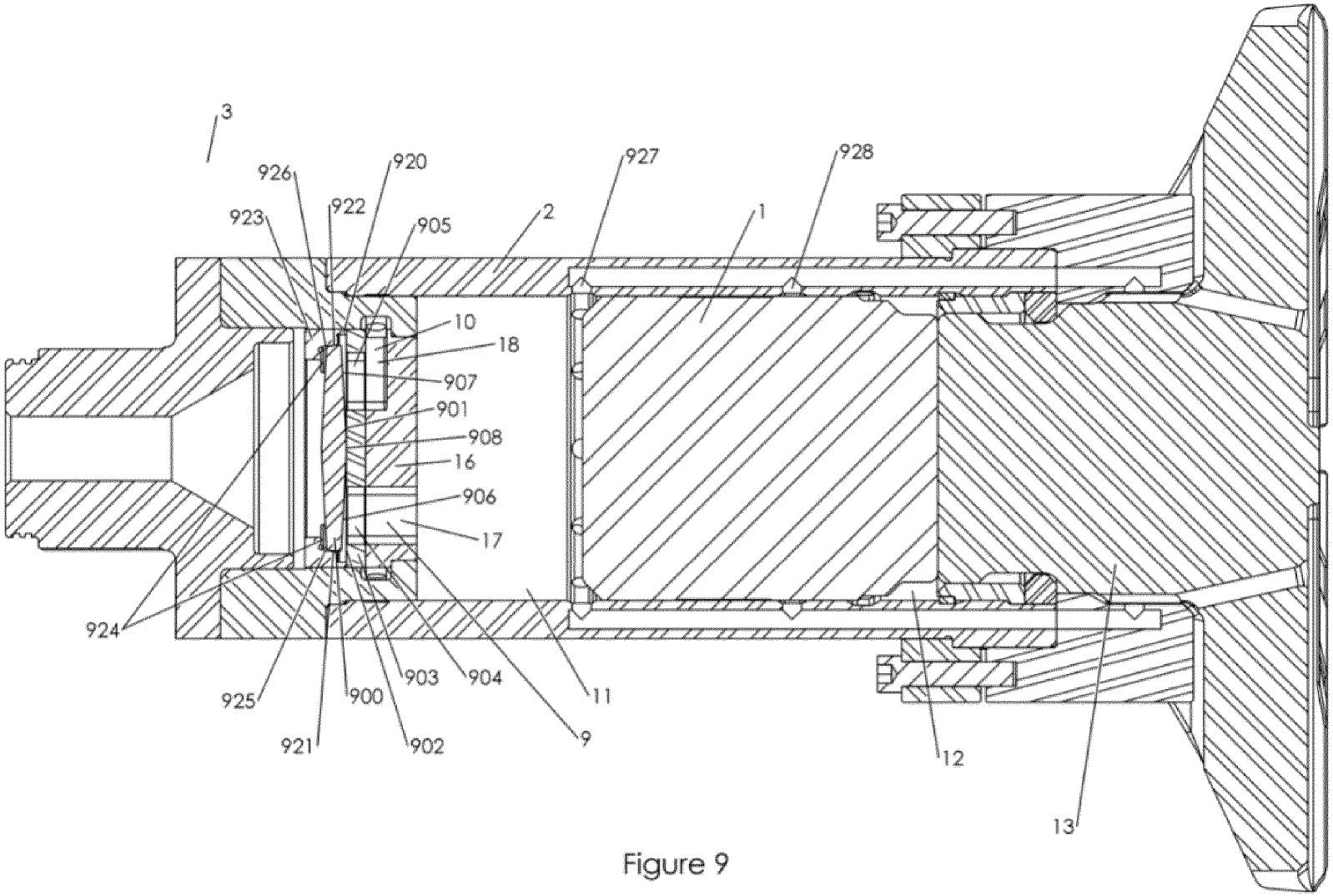
FIG. 9 is a longitudinal cross-sectional view of a down-the-hole hammer including a flapper valve assembly according to the present invention.

FIG. 9 illustrates a down-the-hole hammer comprising a flapper valve assembly 920 according to an embodiment of the present invention. The tool 900 comprises a piston 1 mounted for reciprocal movement within an outer wear sleeve 2. When air is supplied through a backhead assembly 3, the piston acts with percussive effect on a drill bit 13 at a forward end of the wear sleeve.

Pressurised air is supplied from the backhead 3 alternately to upper and lower chambers 11, 12 to cause reciprocation of the piston. This is achieved using the flapper valve assembly 920, which includes a flapper valve 900 having a first side 901 engageable with a planar surface 902 of an intermediate baseplate 903 to alternately close first and second fluid flow paths 17, 18 of the percussion drill tool. The planar surface 902 comprises first and second apertures 904, 905 in fluid communication with the first and second fluid flow paths, respectively. The first side 901 of the flapper valve 900 comprises a first planar portion 906 and a second planar portion 907 and a first curved tip portion 908 intermediate the first and second planar portions. As shown, the first planar portion, the second planar portion and the first curved tip portion form a single continuous surface without intermediate edges, corners or discontinuities. The first and second planar portions 906, 907 of the first side 901 of the flapper valve 900 are equal in length so that the curved tip portion 908 is located along a centre line of the valve, and of the hammer. The valve 900 is pivotable about the first curved tip portion 908 between a first position, in which the first planar portion 906 of the flapper valve is in sealing contact with the planar surface 902 to close the first aperture 904, and a second position, in which the second planar portion 907 of the flapper valve is in sealing contact with the planar surface 902 to close the second aperture 905.

Each end 921, 922 of the flapper valve has a convex profile. The assembly 920 further comprises a flapper valve guide 923 having a pair of internal recesses 924 dimensioned to receive the flapper valve 900. Each internal recess comprises an angled internal surface 925, 926 at its end configured to co-operate with the convex ends 921, 922 of the flapper valve to restrain lateral movement of the flapper valve when the valve pivots between the first and second positions.

The intermediate baseplate 903 is arranged above an air distributor 16. In other embodiments, the plate 903 may be integrally formed with the air distributor 16. One side 9 of the air distributor supplies air to an upper chamber 11 above the piston and the other side 10 of the distributor supplies air to a lower chamber 12 below the piston. The flapper valve 900, shown in a neutral position in FIG. 9, is arranged to pivot about its first curved tip portion 908, as set out above. When the flapper valve is pivoted to one side 9, the first planar portion 906 of the flapper valve is in sealing contact with the planar surface 902 to close the first aperture 904 so that air is routed through aperture 905 in the other side 10 of the baseplate and into channels within the wall of the wear sleeve 2 to exit underneath the piston where it pressurises the lower chamber 12, thereby causing the piston to move upwards, away from the bit 13. The upper chamber 11 is open to exhaust via flow path 927. As the piston moves upwards, a flow path 928 is opened to allow the lower chamber to exhaust. Simultaneously, the flow path 927 from the upper chamber 11 to exhaust is sealed off by the piston and the pressure in the upper chamber therefore increases as the volume of the upper chamber decreases. When the pressure in the lower chamber falls below the pressure in the upper chamber, the pressure differential causes the flapper valve 903 to switch position so that the second planar portion 907 is in sealing contact with the planar surface 902, sealing off aperture 905 in the baseplate 903. Air is then permitted to flow through the aperture 904 in the other side 9 of the baseplate and through the air distributor to further pressurise the upper chamber, thereby pushing the piston back downwards towards the drill bit. As the piston moves downwards, the pressure in the top chamber reduces and the pressure in the lower chamber begins to increase again, restarting the cycle. The flapper valve thus rocks smoothly back and forth about first curved tip portion 908 in a continuous manner, bringing first and second planar portions 906 and 907 alternately into contact with the baseplate 903. Lateral movement of the flapper value 900 is restrained by the guide 923.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A flapper valve assembly comprising:

a flapper valve for a percussion drill tool, the flapper valve comprising:

a first side engageable with a planar surface of an element of the percussion drill tool to alternately close first and second fluid flow paths of the percussion drill tool, the planar surface comprising first and second apertures in fluid communication with the first and second fluid flow paths, respectively, the first side of the flapper valve comprising a first planar portion and a second planar portion and a first curved tip portion intermediate the first and second planar portions, such that the flapper valve is pivotable about the first curved tip portion between a first position, in which the first planar portion of the flapper valve is in sealing contact with the planar surface to close the first aperture, and a second position, in which the second planar portion of the flapper valve is in sealing contact with the planar surface to close the second aperture; and a flapper valve guide having at least one internal recess dimensioned to receive the flapper valve, wherein first and second ends of the flapper valve have a convex profile, and wherein the at least one internal recess comprises an angled internal surface at an end thereof, the angled internal surface being configured to cooperate with the first end or the second end of the flapper valve to restrain movement of the flapper valve when the flapper valve pivots between the first and second positions.

2. A flapper valve assembly as claimed in claim 1, wherein the flapper valve guide comprises a pair of internal recesses, each dimensioned to receive one end of the flapper valve.

3. A flapper valve assembly as claimed in claim 1, wherein the first curved tip portion is directly intermediate the first and second planar portions.

4. A flapper valve assembly as claimed in claim 1, wherein the first planar portion, the second planar portion and the curved tip portion are arranged to form a single continuous surface.

5. A flapper valve assembly as claimed in claim 4, wherein the single continuous surface is such that no edges, corners or discontinuities are formed between the first planar portion, the second planar portion and the curved tip portion.

6. A flapper valve assembly as claimed in claim 1, wherein the first curved tip portion has a radius of curvature in the range 10 mm to 10000 mm.

7. A flapper valve assembly as claimed in claim 1, wherein the first and second planar portions of the first side of the flapper valve are equal in length so that the first curved tip portion is located along a centre line of the flapper valve.

8. A flapper valve assembly as claimed in claim 1, wherein the curved tip portion is offset from a centre line of the flapper valve, so that the first and second planar portions have different lengths.

9. A down-the-hole hammer, comprising:

an external cylindrical outer wear sleeve, a sliding piston mounted for reciprocating movement within the outer wear sleeve to strike a percussion bit of a drill bit assembly located at the forward end of the outer wear sleeve, and a flapper valve assembly, comprising:

a flapper valve, comprising:

a first side engageable with a planar surface of an element of the percussion drill tool to alternately close first and second fluid flow paths of the percussion drill tool, the planar surface comprising first and second apertures in fluid communication with the first and second fluid flow paths, respectively, the first side of the flapper valve comprising a first planar portion and a second planar portion and a first curved tip portion intermediate the first and second planar portions, such that the flapper valve is pivotable about the first curved tip portion between a first position, in which the first planar portion of the flapper valve is in sealing contact with the planar surface to close the first aperture, and a second position, in which the second planar portion of the flapper valve is in sealing contact with the planar surface to close the second aperture, the flapper valve being configured to control a flow of air to cause the reciprocating movement of the sliding piston; and a flapper valve guide having at least one internal recess dimensioned to receive the flapper valve, wherein first and second ends of the flapper valve have a convex profile, and wherein the at least one internal recess comprises an angled internal surface at an end thereof, the angled internal surface being configured to cooperate with the first end or the second end of the flapper valve to restrain movement of the flapper valve when the flapper valve pivots between the first and second positions.

* * * * *